US005346120A

United States Patent [19]

da Costa et al.

[11] Patent Number: 5,346,120

[45] Date of Patent: Sep. 13, 1994

[54] LETTER BLANK

[76] Inventors: Damion A. G. R. da Costa; Simon R. G. R. da Costa, both of Merton Lodge, Middle Lincombe Road, Torquay, TQ1 2NE, United Kingdom

[21] Appl. No.: 39,334

[22] PCT Filed: Oct. 30, 1991

[86] PCT No.: PCT/GB91/01906

§ 371 Date: Apr. 27, 1993

§ 102(e) Date: Apr. 27, 1993

[87] PCT Pub. No.: WO92/07725

PCT Pub. Date: May 14, 1992

[30] Foreign Application Priority Data

| | | | |
|---|---|---|---|
| Oct. 30, 1990 | [GB] | United Kingdom | 9023594 |
| Nov. 24, 1990 | [GB] | United Kingdom | 9025599 |
| Jun. 19, 1991 | [GB] | United Kingdom | 9113256 |

[51] Int. Cl.[5] ..... B65D 27/14

[52] U.S. Cl. ..... 229/92.5; 229/92.1

[58] Field of Search ..... 229/92.5, 92.1

[56] References Cited

U.S. PATENT DOCUMENTS

| | | | |
|---|---|---|---|
| 2,872,100 | 2/1959 | Coffin | 229/921 |
| 3,197,121 | 7/1965 | Hayes, Jr. | 229/92.1 |
| 3,902,655 | 9/1975 | Huffman | 229/92.1 X |

FOREIGN PATENT DOCUMENTS

| | | | |
|---|---|---|---|
| 898670 | 5/1945 | France . | |
| 52802 | 8/1945 | France | 229/92.1 |
| 2388727 | 11/1978 | France . | |
| 11831 | of 1901 | United Kingdom | 229/92.1 |
| 624919 | 6/1949 | United Kingdom . | |

*Primary Examiner*—Allan N. Shoap
*Assistant Examiner*—Jes F. Pascua
*Attorney, Agent, or Firm*—Ira S. Dorman

[57] ABSTRACT

A letter blank has leading and trailing edges (1 and 2) and side edges (3 and 4). The blank includes a central oblong rectangular letter section (108) and a marginal edge section (205), the latter being joined by perforations (216) and carrying adhesive areas (218, 219 and 220). The letter section (108) can be folded into four portions (212, 213, 214 and 215) by folding along crease lines (9, 10 and 11), forming its own envelope which can be secured by means of the adhesive areas. In the folded configuration the shorter portions (213 and 214) are fully enclosed between the longer portions(212 and 215).

1 Claim, 4 Drawing Sheets

LETTER BLANK

TECHNICAL FIELD OF THE INVENTION

This invention relates to blanks for handwritten, typed, printed and/or photocopied letters.

BACKGROUND

There is currently a trend towards saving raw materials, and particularly timber based products such as paper. Many letters and envelopes are now available in recycled paper, but the present invention is intended to produce a further saving in raw materials.

Existing Air Mail letter blanks which can be folded to form their own envelopes have the advantage that they save postage on the weight of an envelope. Such airmail blanks are printed and cut to shape in the manufacturing process in huge quantities. Whilst this is economical where large runs are concerned, this process is not suitable for smaller print runs where the cost would be prohibitive. A blank of the standard air mail letter shape will not pass through the most commonly used forms of printing machine.

Reply cards which can be folded in two and secured by peripheral adhesive are also known, but these are limited in size. A standard A4 letter embodying this principle would need to be made of heavy paper and would be inconvenient to handle.

An object of the present invention may be viewed as being to provide a form of letter blank which is capable of being printed in small quantities such as would be typical for letterheadings in the domestic and small business sectors, and which is both easy to use and results in a compact shape which is convenient for posting.

SUMMARY OF THE INVENTION

The present invention proposes a letter blank which can be printed by an offset litho process and having two pairs of opposed edges, the blank including a substantially rectangular letter portion and adhesively coated marginal portions, and the arrangement being such that the blank can be folded to form its own envelope which can be secured by means of the marginal portions.

In one form of the letter blank the letter portion includes two mutually perpendicular folds which divide the letter portion into four substantially equal rectangular portions, and said marginal portions comprise two adhesively coated flaps provided on mutually adjacent edges of said blank.

In another form of the letter blank the marginal portions include user-removable portions which are defined by perforations such that, after printing, the said portions can be removed to leave at least two adhesively coated flaps for use in securing the blank when folded to form its own envelope.

The term "user-removable" is intended to include removal by the printer, although in most instances it is envisaged that the removable portions will be removed by the end user. The letter may more easily pass through a typewriter or the like if the removable portions are still in place. In addition, the term "perforation" is intended to cover holes of any shape, including slits.

In a further form of the blank there is a row of perforations between the marginal portions and the letter portion, and the blank includes three folds which are substantially parallel to each other and to a first pair of said opposed edges, said folds including a first fold disposed substantially mid-way between said first pair of edges, and two further folds, made in opposite directions to the first fold, disposed substantially equidistant either side of said first fold.

In each form of the letter blank it is preferred that:

a first pair of said edges includes a leading edge which is such that it can stably abut a straight datum line, and an opposite trailing edge, a second pair of said edges has:

(i) first mutually parallel straight edge portions which are substantially perpendicular to said datum line and extend towards the leading edge for at least 10mm from a point 35mm from the datum line, (ii) second mutually parallel straight edge portions which are substantially perpendicular to said datum line, are at least 8mm long, and lie within 35mm of the trailing edge, and (iii) at least one edge of said second pair having a third edge portion which is at least 35mm long and is substantially perpendicular to said datum line and extends between 90mm and 55mm from said leading edge.

A blank meeting these criteria has the advantage that it can be printed by certain litho print machines. The first and second edge portions allow location by the front and rear adjustable paper guides in an offset litho machine such as the Rotaprint 30/95, and the third edge portion allows for engagement by the stroker which feeds the sheets into the machine.

The trailing edge preferably includes a pair of straight, mutually aligned fourth edge portions which are each at least 30mm long, span at least 100mm between their outer ends, and are substantially parallel to said datum line. These portions can be engaged by the weighted back stops of the machine. The two fourth edge portions may in practice be provided by a single straight edge portion with is at least 100mm long.

BRIEF DESCRIPTION OF THE DRAWINGS

The invention is exemplified below with reference to the accompanying drawings, in which.

DETAILED DESCRIPTION OF THE ILLUSTRATED EMBODIMENTS

The illustrated letter blanks are substantially rectangular having a leading edge 1, a parallel trailing edge 2 and a pair of longer parallel side edges 3 and 4. Each blank includes a central oblong rectangular letter portion 108 surrounded by various marginal edge portions,. as described below. Although it could be of any other desired size, the blank will usually be of A4 size (i.e. about 297 mm by 210 mm).

Figure 1:
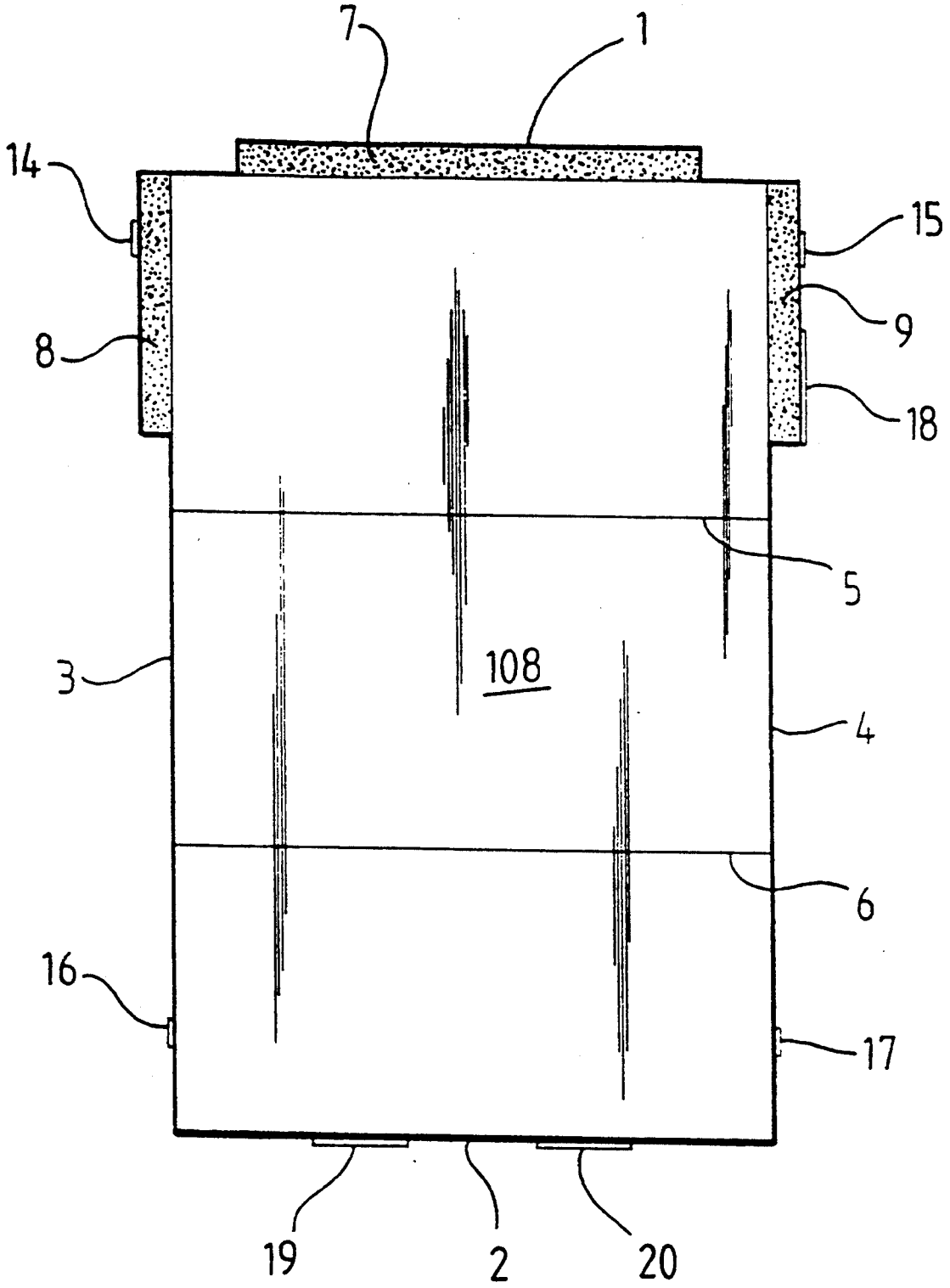
FIGS. 1 to 3 show plan views of three different forms of letter blank of the invention.

In the blank of FIG. 1, the letter portion 108 can be folded into three equal portions by folding along two crease lines 5 and 6 which are parallel with the leading edge 1. The letter portion 108 is joined to a gummed marginal flap 7 which forms a straight leading edge 1 and is of such a length that it can stably abut a straight edge. The side edges 3 and 4 include two further gummed marginal flaps 8 and 9 located between the leading edge 1 and the first crease line 5.

Figure 2:
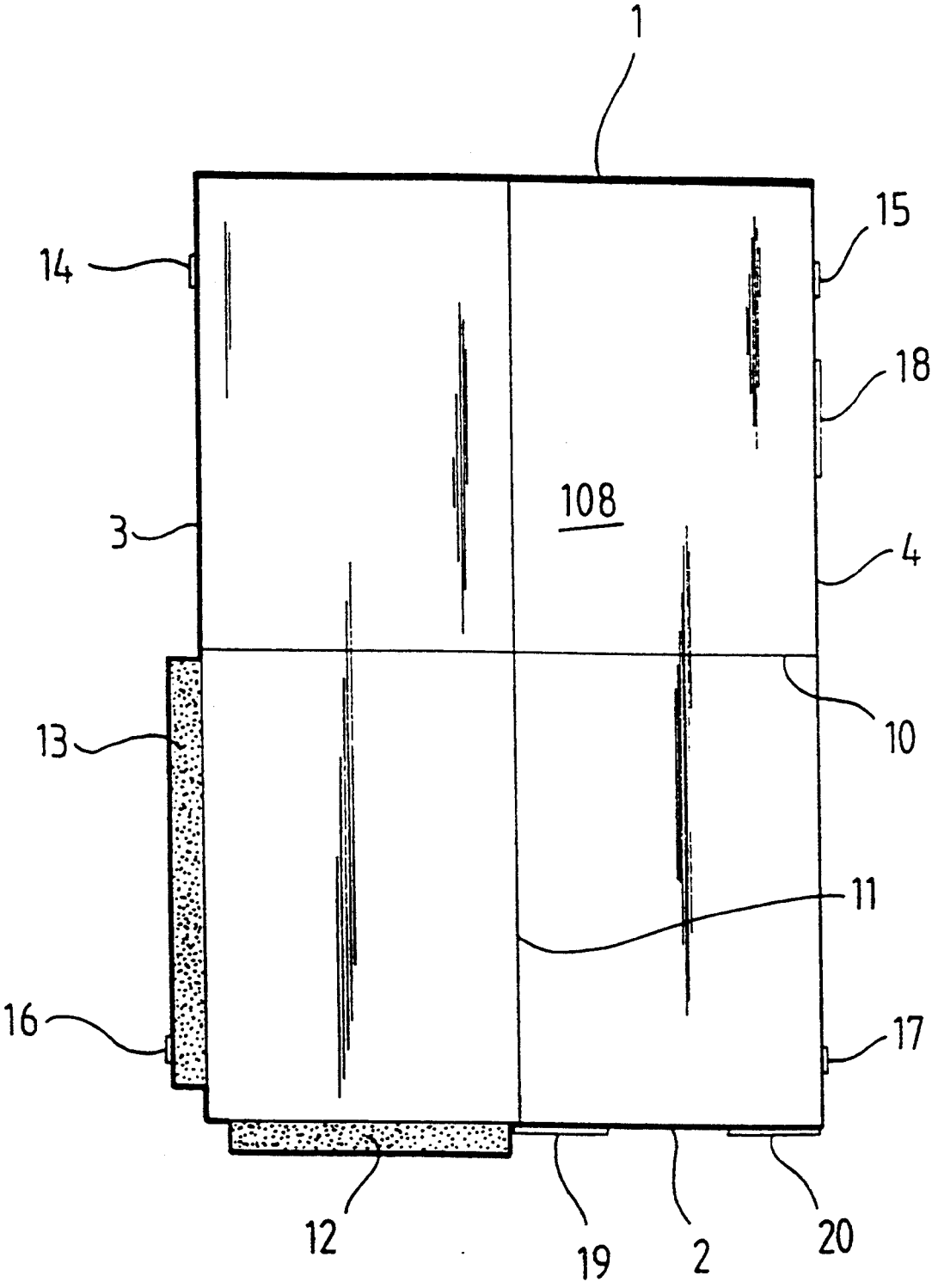

The blank of FIG. 2 has a straight leading edge 1 and the letter portion 108 can be folded into four equal portions along two mutually perpendicular crease lines 10 and 11. The trailing edge 2 includes a gummed marginal flap 12 located between crease line 11 and side edge 3, and the side edge 3 has a further gummed marginal flap 13 located between the crease line 10 and the trailing edge 2.

The blanks can thus be folded along the respective crease lines to form their own envelopes which can be secured by moistening the gummed flaps.

In both forms of the blank described above the flaps could be separated from the letter portion 108 by a row of perforations to facilitate opening of the letter.

The blank of FIG. 3 again has a straight leading edge 1 and includes marginal portions 105, 106 and 107 which extend along the side, trailing and side edges 3, 2 and 4 respectively. The letter portion 108 is provided with two crease lines 5 and 6 which extend parallel with the top edge 1 and divide the letter portion into three portions 111, 112 and 113, the bottom two portions 112 and 113.

The bottom margin 106 forms a central flap 114 which is joined to the letter portion 108 by a row of perforations 117. The length of the flap 114 is slightly less than the width of the letter portion 108.

The side margins 105 and 107 include further flaps 120 and 121 and user-removable side portions 122 and 123. The flaps 120 and 121 are separated from the side portions 122 and 123 by notches 126 and 127. These side flaps 120 and 121 are joined to the bottom third 113 of the letter portion 108 by perforations 128 and 129. The removable portions 122 and 123 are each joined to the top and middle thirds 111 and 112 of the letter portion 108 by a row of perforations or slits 130, 131 respectively.

The flaps 114, 120 and 121 are each provided with a layer of adhesive.

The blanks can be fed through most typewriters or printers used with word processors. The user can then remove the side portions 122 and 123, which are easily separated from the letter portion 108. Longer slits offer less resistance to removal than perforations in the form of circular holes or shorter slits so that it is preferred for the user-removable portions 122 and 123 to be secured to the letter portion 108 predominantly by longer slits whereas the flaps 114, 120 and 121 will be secured to the letter portion predominantly by holes or slits of much shorter length.

The letter portion 108 can be folded along the crease lines 5 and 6 to form its own envelope, which can be secured by moistening the gummed flaps 114, 120 and 121 and folding them along the perforations 117, 128 and 129 so that the flaps adhere to the letter portion 108.

When the letter is required to be opened the perforations 117, 128 and 129 allow easy separation of the flaps from the letter portion 108.

It will be appreciated that the shape and position of the flaps and the arrangement of the slits and/or perforations described above is purely illustrative. The same principle could be used with any form of letter which can be folded to form its own envelope which can be secured by two or more flaps. For example, the letter portion 8 could be divided into four substantially equal square or oblong rectangular portions by two mutually perpendicular creases, and two adjacent edges of the letter portion are provided with two flaps for securing the letter as its own envelope.

Figure 3:
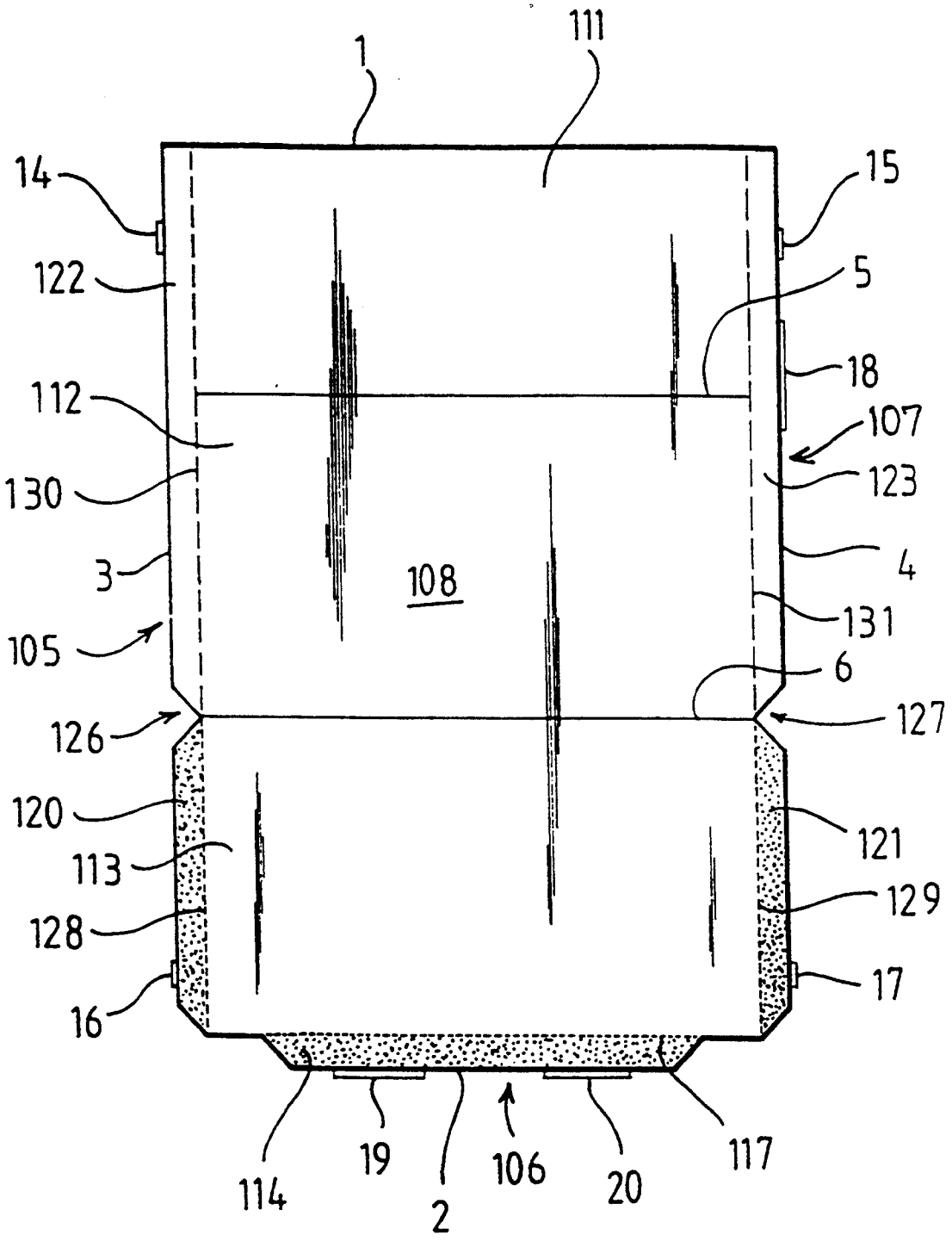

In each of the blanks of FIGS. 1 to 3 the flaps and the corresponding areas of the letter portion could be coated with pressure-sensitive or other adhesives.

Figure 4:
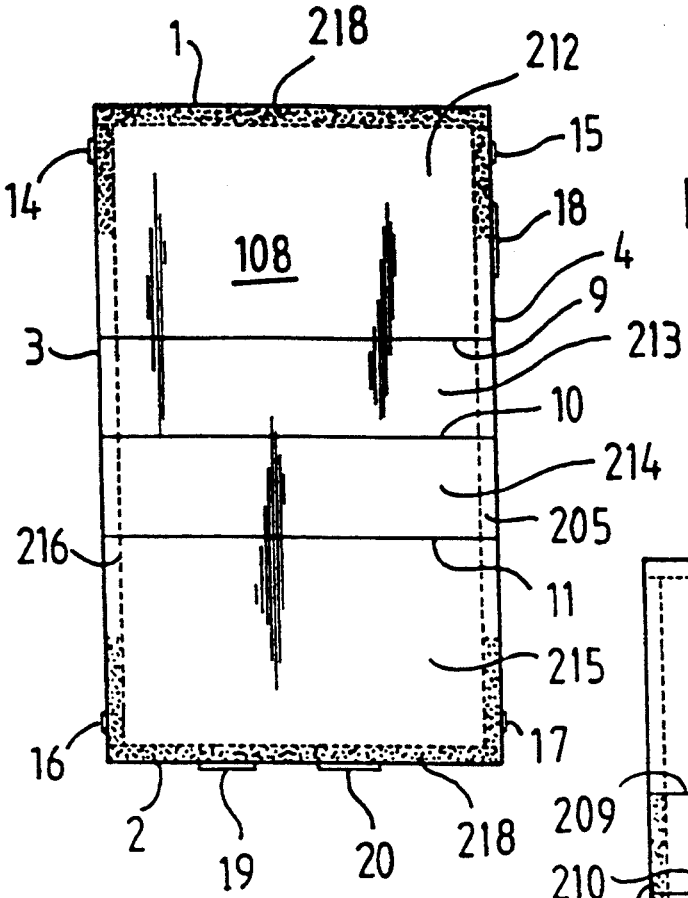
FIG. 4 is a front view of a fourth form of letter blank of the invention.
Figure 5:
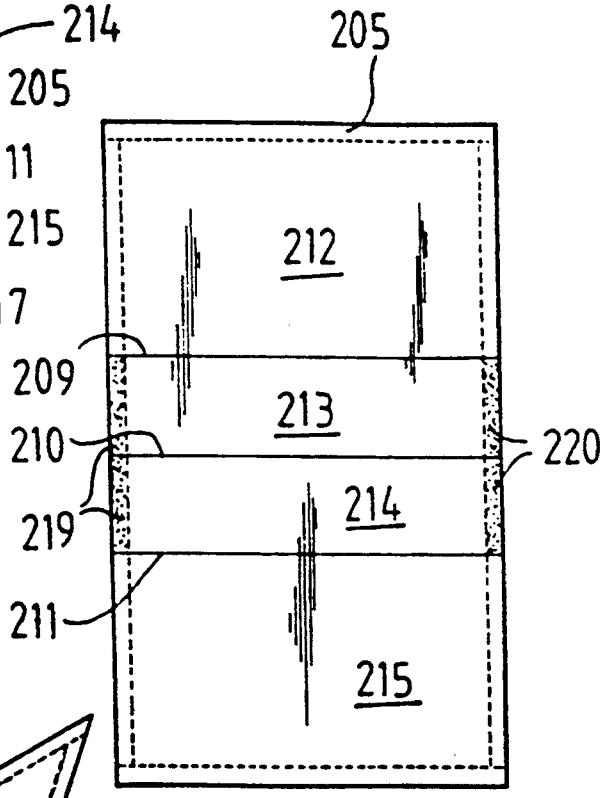
FIG. 5 is a rear view of the letter blank of FIG. 4.
Figure 6:
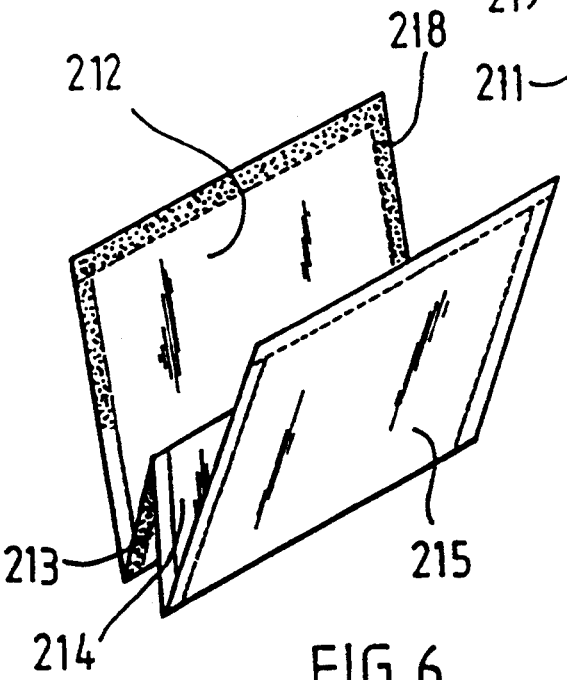
FIG. 6 is a perspective view of the letter blank of FIGS. 4 and 5 in a partially folded configuration.

The blank of FIGS. 4 to 6 has a straight leading edge 1 and includes a continuous marginal edge portion 205 which completely surrounds the letter portion 108. The blank is provided with three crease lines 209, 210 and 211, which extend parallel with the top edge 1 and divide the blank into four portions 212–215, the top and bottom portions 212 and 215 being of equal size and the two centre portions 213 and 214 being of equal size but shorter than the other two. The centre crease 210 is made in the opposite direction to the other two creases 209 and 211 so that when the blank is folded as shown in FIG. 6, the two middle portions 213 and 214 are sandwiched between the top and bottom portions 212 and 215 in the manner of a W. The front surface of the blank is thus completely enclosed.

Referring back to FIG. 4, the edge portion 205 is joined to the letter portion 108 by a row of perforations 216. On the front surface of the blank the edge portion 205 is provided with areas 218 of pressure sensitive adhesive. The front adhesive layer 218 is arranged in two areas around the top and bottom portions 212 and 215 of the blank such as to adhere them together when the blank is folded as shown in FIG. 6. On the opposite rear surface of the blank (FIG. 5) the edge portion 205 bordering both sides of the centre regions 213 and 214 is provided with two further layers 219 and 220 of pressure sensitive adhesive. These layers 219 and 220 are arranged so as to adhere together the two centre portions 213 and 214 when the blank is folded. Since the adhesive areas 218, 219 and 220 adhere only to themselves, not to the paper, similar letter blanks can be stacked without adhering to each other.

Again, the blank can be fed through most typewriters or printers. The user can then fold the blank along the crease lines 29, 210 and 211 to form its own envelope, which is secured by the adhesive layers.

Instead of using pressure-sensitive adhesive the edge portion 205 could be coated with various adhesives including water-soluble adhesive.

When the letter is required to be opened the perforations 216 allow easy separation of the adhesively secured edge portion 205 from the letter portion 108, which can then be opened out and read as a normal letter.

It will be appreciated that the position of the adhesive areas 218 to 220 could be varied. For example, the entire front surface of the edge portion 205 could be adhesively coated.

In each of the above-described embodiments, it will be noted that if the letter is sent through the post the rear of the letter will be date franked, thereby providing a useful permanent record of the posting date.

In each form of blank described above, the side edges 3 and 4 have the following:

(i) First mutually parallel straight edge portions 14 and 15 which are substantially perpendicular to the leading edge 1 and extend towards the leading edge for at least 10mm from a point 35mm from the leading edge.

(ii) Second mutually parallel straight edge portions 16 and 17 which are substantially perpendicular to the leading edge, are at least 8mm long, and lie within 35mm of the trailing edge 2.

(iii) A third edge portion 18 of the edge 4 which is at least 35mm long land is substantially perpendicular to the leading edge 1 and extends between 90mm and 55mm from the leading edge.

In addition, the trailing edge includes a pair of straight, mutually aligned fourth edge portions 19 and 20 which are each at least 30mm long, are separated by 40mm, and are substantially parallel to the leading edge 1.

The first and second edge portions 14, 15 and 16, 17 permit location of the blank by the front and rear adjustable paper guides in an offset litho machine such as the Rotaprint 30/95. The third edge portion 18 can be engaged by the stroker which feeds the sheets into the machine. The fourth edge portions 19 and 20 are engaged by the weighted back stops of the machine.

The blanks can thus be printed on by most, if not all, of the commonly used forms of offset litho printing machine.

Although the blanks of FIG. 3 will normally be printed with the flaps 114, 120 and 121 at the bottom of the letter they could also be printed with the flaps at the top.

It will also be appreciated that although the blanks have been shown as separate sheets they could also be joined at the leading and trailing edges 1 and 2 to form continuous stationery.

Having thus described the invention What is claimed is:

1. A letter blank having front and rear faces, said blank comprising:

a substantially rectangular letter section having opposite sides with first opposed edges, and opposite ends with second opposed edges perpendicular to said first edges; and at least a first pair of marginal edge strips of substantially constant width extending continuously, from end to end along said first pair of opposed edges of said letter section, said edge strips being joined to said letter section by respective rows of perforations enabling said edge strips to be torn away from said letter section; said letter blank including three mutually parallel crease lines which extend from side to side, parallel to said second pair of edges, to divide said blank into a top portion, a bottom portion, and two middle portions, said top and bottom portions being substantially identical to one another in size, and said two middle portions being substantially identical to one another in size, said middle portions being of the same width as said top and bottom portions and being substantially shorter, from end to end, than said top and bottom portions such that, when said letter blank is fan folded on said crease lines, with said top and bottom portions opposed and said middle portions disposed therebetween, said top and bottom portions completely enclose said middle portions and extend substantially beyond said middle portions to partially overlie each other directly; each of said marginal edge strips being provided with at least one adhesively coated area on said front face of said blank along at least one of said top and bottom portions, for securing the opposed top and bottom portions together, and each of said marginal edge strips being provided with at least one adhesively coated area on said rear face of said blank along at least one of said middle portions, for securing said two middle portions together, whereby contacting portions of said edge strips can be secured to one another with said blank fan folded, and whereby said edge strips can be torn away to thereby enable said letter section to be fully opened into a flat, rectangular sheet.

* * * * *